US005646594A

United States Patent [19]

Barben, Jr. et al.

[11] Patent Number: 5,646,594

[45] Date of Patent: Jul. 8, 1997

[54] DECORATIVE REMOTE LIGHTING APPARATUS

[76] Inventors: Carl L. Barben, Jr.; Grace C. Barben, both of 3301 W. 121st Ter., Shawnee Mission, Kans. 66209

[21] Appl. No.: 547,865

[22] Filed: Oct. 25, 1995

[51] Int. Cl.[6] ..... G08B 13/191; G08B 13/193

[52] U.S. Cl. ..... 340/567; 340/693

[58] Field of Search ..... 340/567, 693

[56] References Cited

U.S. PATENT DOCUMENTS

| | | | |
|---|---|---|---|
| D. 269,072 | 5/1983 | Sweet et al. | D10/106 |
| D. 330,339 | 10/1992 | Roselle et al. | D10/106 |
| D. 345,313 | 3/1994 | Bedrosian | D10/106 |
| 3,544,988 | 12/1970 | Astheimer | 340/572 |
| 3,956,743 | 5/1976 | Geiszler et al. | 340/561 |
| 4,618,770 | 10/1986 | Maile | 340/567 |
| 4,904,988 | 2/1990 | Nesbit et al. | 340/693 |
| 4,992,701 | 2/1991 | Sacchetti | 315/159 |
| 5,128,654 | 7/1992 | Griffin et al. | 340/567 |
| 5,136,213 | 8/1992 | Sacchetti | 315/159 |
| 5,309,145 | 5/1994 | Branch et al. | 340/540 |
| 5,386,210 | 1/1995 | Lee | 340/567 |

*Primary Examiner*—Glen Swann

*Attorney, Agent, or Firm*—John D. Gugliotta; David L. Volk

[57] ABSTRACT

Fresnel lenses are incorporated into bear's paws of a child's toy teddy bear. The Fresnel lenses cover infrared detectors, and gather infrared energy and focus it onto the infrared sensors. The signal generated by the infrared sensors is passed to a detector timer assembly and then to a power control device. The detector assembly consists of a low-pass filter, a level comparator, a variable time-on timer, and a daylight override circuit. The power control device provides power to an outlet.

5 Claims, 5 Drawing Sheets

* POWER FURNISHED TO NON-REACTIVE LOAD IS DEPENDENT ON DIMMER SWITCH LEVEL SETTING.

* POWER FURNISHED TO NON-REACTIVE LOAD IS DEPENDENT ON DIMMER SWITCH LEVEL SETTING.

DECORATIVE REMOTE LIGHTING APPARATUS

BACKGROUND OF THE INVENTION

Field of the Invention

The present invention relates generally to security lighting devices and, more particularly, to a decorative apparatus which is utilized to remotely engage room lighting upon sensing the incoming presence of an individual.

Description of the Related Art

In the related art, many electronic light-switching devices are known and utilized for a variety of security purposes. For example, in U.S. Pat. No. 5,136,213, issued in the name of Sacchetti, a motion detection light controller system is disclosed comprising a light bulb socket adapter having a control circuit for the light which is controlled. Other examples are known having similar utility, such as U.S. Pat. No. 3,956,743 issued in the name of Geiszler et al., U.S. Pat. No. Des. 345,313 issued in the name of Bedrosian, U.S. Pat. No. Des. 330,339 issued in the name of Roselie et al., and U.S. Pat. No. Des. 269,072 issued in the name of Sweet et al. Disclosed in these various references are motion detection systems, or ornamental designs utilizing motion detection systems. None of these disclosed references, however, can be utilized to remotely engage room lighting upon sensing the incoming presence of an individual as well as simultaneously blend into the background decor of a user's residence. Neither do any of these references provide the capability to automatically dim lighting, shut off quickly, and adjust the sensitivity of the detector.

Another problem arises from the need to utilize remote, automatic light switching at various points in a portable manner. One attempt to address such a problem is identified in U.S. Pat. No. 5,309,145, issued in the name of Branch et al. Disclosed in the Branch et al. reference is a travel convenience and security device. As disclosed in the Branch et al. reference, a clock, a lamp, an alarm, a motion detector and a smoke alarm are combined into an apparatus which can provide the function of each of these features in a portable device for use while traveling. However, although such a device appears to be useful in its unique combination of elements, it contains an integral lighting source and cannot be utilized to activate existing room lighting.

Consequently, a need has long been felt for providing an apparatus which can provide a motion detecting light controller system capable of dimming lighting based upon time, shutting off when sensing daylight, as well as being contained in an aesthetically pleasing manner such as to simultaneously blend into the background decor of a user's residence

SUMMARY OF THE INVENTION

It is therefore an object of the present invention to provide an improved motion detection light controller system.

It is yet another object of the present invention to provide an improved motion detection light controller system which can also be utilized to activate other devices, such as radios, burglar alarms, store advertising displays, or any electronic device where it would be advantageous to activate only upon the approach or within the presence of people.

It is yet another object of the present invention to provide an improved motion detection light controller system which is moveable as well as being capable of sitting on a table, bookshelf, counter top, or floor and positioned in any direction.

It is yet another object of the present invention to provide an improved motion detection light controller system which can be housed in or manufactured into a number of decorative articles, such as toys (i,e., animals, people, figures, etc.), books, boxes, pottery, or the like.

It is yet another object of the present invention to provide an improved motion detection light controller system which can be manually overridden to allow for normal appliance function.

It is yet another object of the present invention to provide an improved motion detection light controller system which can sense the presence of daylight and thereby turn off any lighting appliance when the addition of artificial light is unnecessary.

It is a feature of the present invention to provide an improved motion detection light controller system which utilizes one or more infrared sensors covered by Fresnel lenses which gather IR energy from a sector of approximately 90 degrees and focus it onto the infrared sensor.

Briefly described according to one embodiment of the present invention, a motion detection light controller system is disclosed capable of being housed within a portable decorative object, for example, a child's toy teddy bear. In such a particular embodiment, Fresnel lenses are incorporated into the bear's paws. The Fresnel lenses cover infrared detectors, and gather infrared energy and focus it onto the infrared sensors. The signal generated by the infrared sensors is passed to a detector timer assembly and then to a power control device. The detector assembly consists of a low-pass filter, a level comparator, a variable time-on timer, a daylight override circuit and an optional detector-sensitivity adjustment means. The power control device provides power to an outlet.

In operation, when an individual crosses the detection area, a pulse is emitted by the infrared sensor. This pulse is passed to the detector timer assembly where it is conditioned by the low-pass filter, compared for proper level by the level comparator and starts the variable time-on timer, causing the output signal to go active for a predetermined time before going inactive again when time has expired. This output signal is passed to the power control device and relay to provide power to the outlet. As long as motion continues to be detected, the time-on timer is prevented from timing out and turning the lamp off. If no motion is detected for a predetermined time-on period, the timer times out and turns off the lamp. A time-on selector allows the user to select the length of the time-on period, or length of time the lamp remains on after motion is no longer detected.

An advantage of the present invention is that the improved motion detection light controller system can be utilized in a portable manner to sense motion and engage a standard lighting device, such as a lamp.

Another advantage of the present invention is that the improved motion detection light controller system can be utilized to activate other devices, such as radios, burglar alarms, store advertising displays, or any electronic device where it would be advantageous to activate only upon the approach or within the presence of people.

Another advantage of the present invention is that the improved motion detection light controller system is compact and moveable, thereby being capable of sitting on a table, bookshelf, counter top, or floor and positioned in any direction.

Another advantage of the present invention is that the improved motion detection light controller system can be housed in or manufactured into a number of decorative articles, such as toys (i.e., animals, people, figures, etc.), books, boxes, pottery, or the like.

Yet another advantage of the present invention is that the improved motion detection light controller system contains a built-in light dimmer which allows for intensity adjustment of a lamp in conjunction with on/off control.

A further advantage of the present invention is that the improved motion detection light controller system can be manually overridden on or off to allow for normal appliance function.

A final advantage of the present invention is that the improved motion detection light controller system can sense the present of daylight and thereby turn off any lighting appliance when the addition of artificial light is unnecessary.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Detailed Description of the Figures

Figure 1:
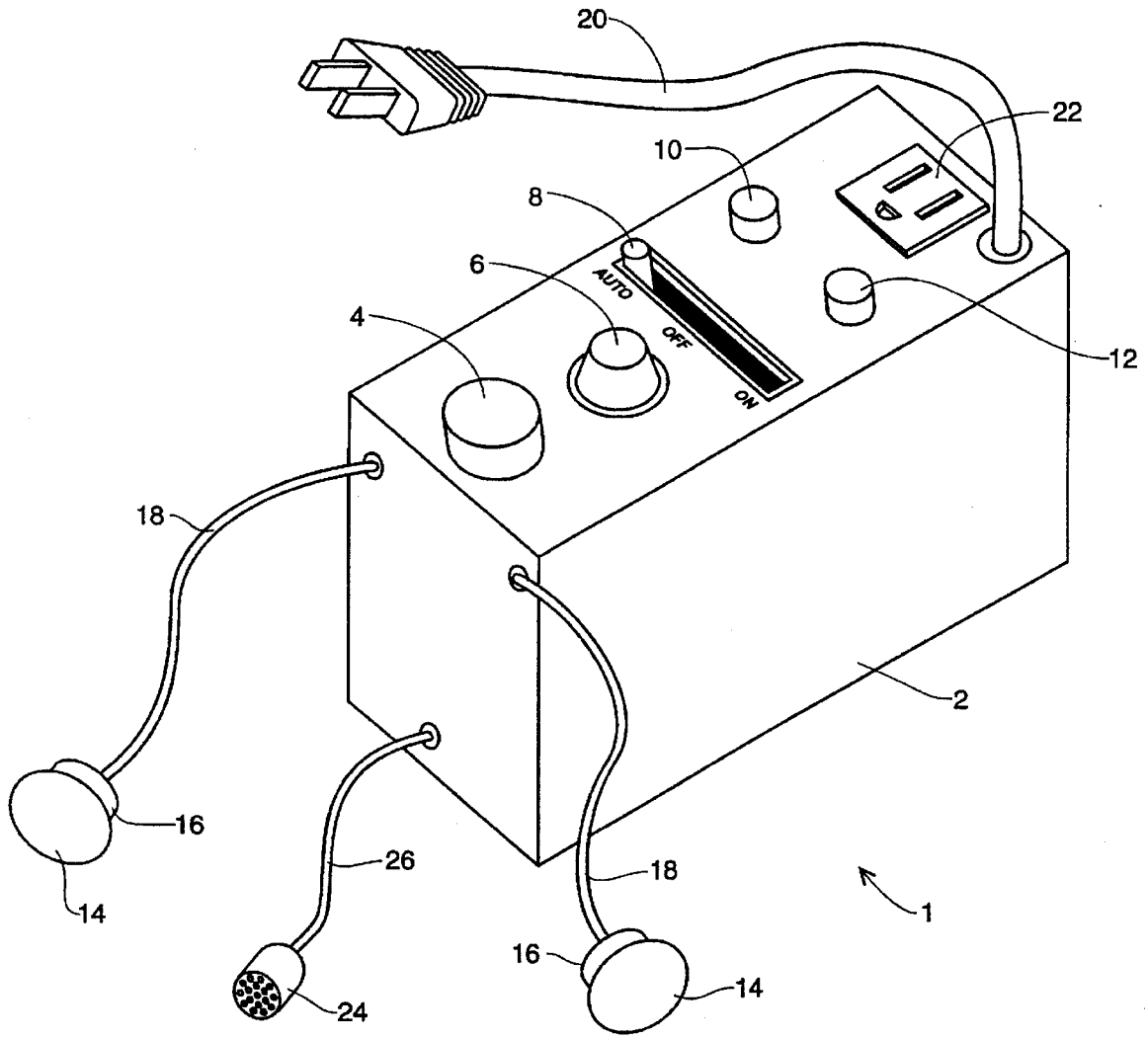
FIG. 1 is an orthographic view of the outside of a motion detection light controller system for use with the present invention.

Referring now to FIG. 1, a motion detecting light controller system, generally referred to as controller system and noted as 1, is shown from the outside, according to the present invention, having a housing 2 for containing the electronic components as will be described in further detail below. Controls for the controller system I are accessible from the outside of the housing 2, and include at least a dimmer control 4, a manual quick-off override 6, a mode selection means 8, a sensitivity adjustment means 10, and a time-on selection control 12. In addition, a plurality of Fresnel lenses 14 are mountable remotely each to an infrared pyroelectric detector 16, and can communicate via a first signaling means 18, preferably in the form of a cable, back to the electronics located in the housing 2. A power supply cord 20 supplies the necessary energy, as well as a power outlet 22 accessible from the outside of the housing 2, which provides a controlled power source for any standard lamp or 110 volt appliance. Finally, a daylight override sensor 24 can be remotely mounted, and communicate to the electronics located in the housing 2 via a second communication means 26.

Figure 2:
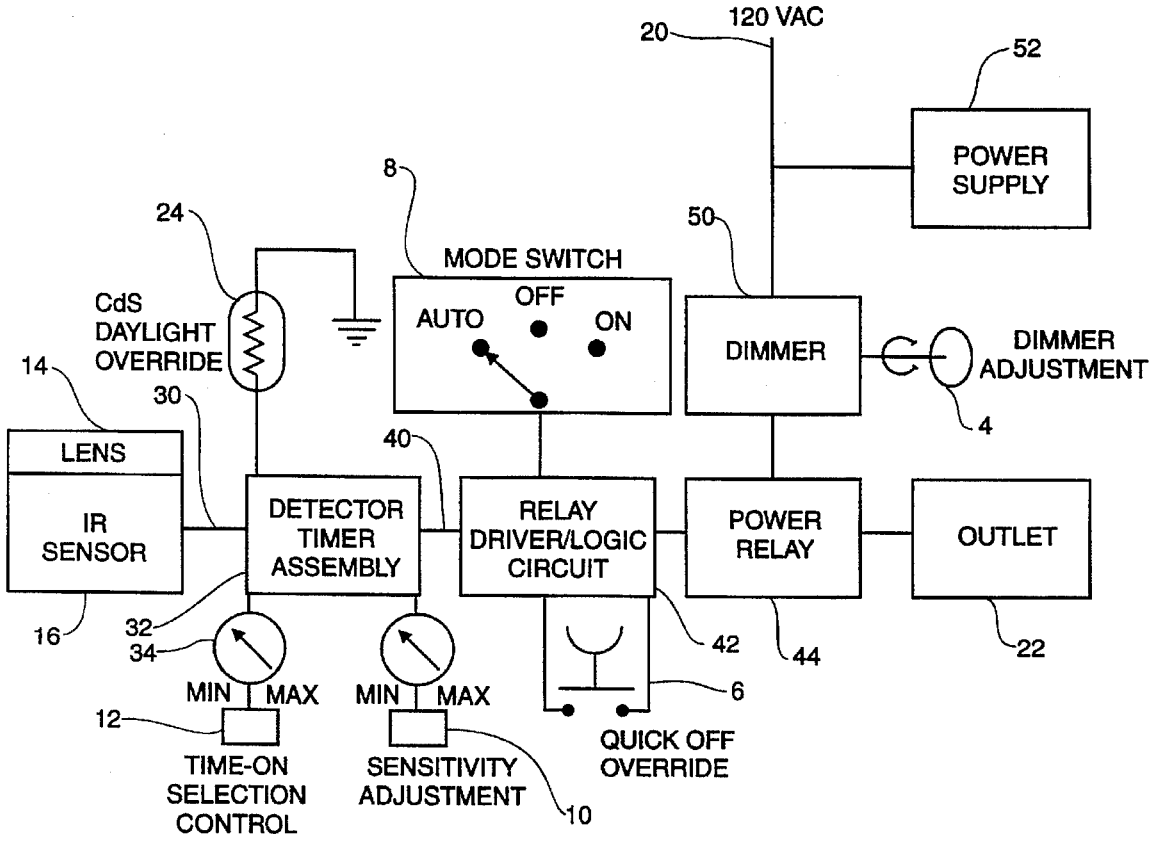
FIG. 2 is a block diagram of the operation of the motion detection light controller system depicted in FIG. 1.

Referring to FIG. 2, the detailed operation of the control electronics can be more clearly understood. Motion is detected by the infrared pyroelectric detector 16 in combination with the Fresnel lens 14. One or more of these sensor/lens combinations can be utilized in order to provide multi-directional motion detection. Each Fresnel lens 14 covering an infrared pyroelectric detector 16 gathers infrared energy from a sector of approximately 90 degrees and focusses it onto the infrared sensor 16. Although it is currently envisioned that other specific devices could be utilized, it has been found that a Hamamatsu Type E5141 Fresnel lens or equivalent in combination with Hamamatsu Type P4488 Series Pyroelectric Detectors will provide adequate infrared gathering and focussing capabilities in order to be effectively utilized within the present invention. It is known that such a configuration provides a detection area of an approximate range from between three to sixteen feet, depending upon the angle of approach to the detector. It is also currently envisioned that for applications requiring detection of a human body at a short distance of approximately one to six feet through a narrower arc, a Hamamatsu Dual Element with Lens Cap Type P3514 may also be utilized for certain applications, and thereby eliminate the need for a separate Fresnel lens 14. The infrared pyroelectric detectors 16 detect infrared energy and convert such energy, due to motion from side to side across the detection area, into an electronic signal, herein transmitted via a third communication means 30. Due to this preferred operation, the present invention would be best utilized if positioned to detect motion from a person entering a room if situated such that a person would penetrate the detection area in a perpendicular direction.

The third communication means 30 transmits the converted infrared signal to a detector timer assembly 32 where it is conditioned by a low-pass filter integral to the detector timer assembly electronics and compared for proper level by a level comparator, also integral to the detector timer assembly electronics. Upon determination of proper signal level, a time-on timer 34, set via the time-on selection control 12, starts to run. While running, the time-on timer 34 causes an output signal from the detector timer assembly 32, transmitted via a fourth communication means 40, to go active for a predetermined time before going inactive again when time has expired. This output signal is passed to a relay driver logic circuit 42, which controls a power relay 44 controlling the flow of power to the power outlet 22. As long as motion continues to be detected, the time-on timer 34 is prevented from timing out and turning off power to the power outlet 22. If no motion is detected for a predetermined period as set via the time-on selection control 12, the detector timer assembly 32 times out and signals the relay driver logic circuit 42 to turn off. A mode selection means 8 allows this timer function to be bypassed, thereby directly engaging or disengaging the power relay 44. In addition, a manual quick-off override 6 immediately disengages the power relay 44 and turns off power to the power outlet 22. Automatic operation is again assumed at the end of the time-on time. Also, the output signal generated by the detector timer assembly 32 and transmitted via the fourth communication means 40 can be disabled by the daylight override sensor 24. Although it is currently envisioned that many such sensors are currently available to function as the daylight override sensor 24, in its preferred embodiment the daylight override sensor 24 consists of a cadmium-sulfide photocell circuit to detect daylight. Further, the dimmer adjustment means 4 is utilized to control a standard, variable phase angle controlled dimmer 50, and can provide for intensity adjustment of the power provided to the power outlet 22. This can be utilized to provide for a dimmed light when a standard lamp is plugged into the power outlet 22.

Finally, the power supply cord 20 not only provides power to the outlet 22 through the dimmer 50 and the power relay 44, but also must supply power to a power supply 52 which is utilized to provide isolated, low voltage power to the infrared motion detectors 16, the detector timer assembly 32, the relay control driver circuit 42, and the power relay 44.

Operation of the Preferred Embodiment

Figure 3:
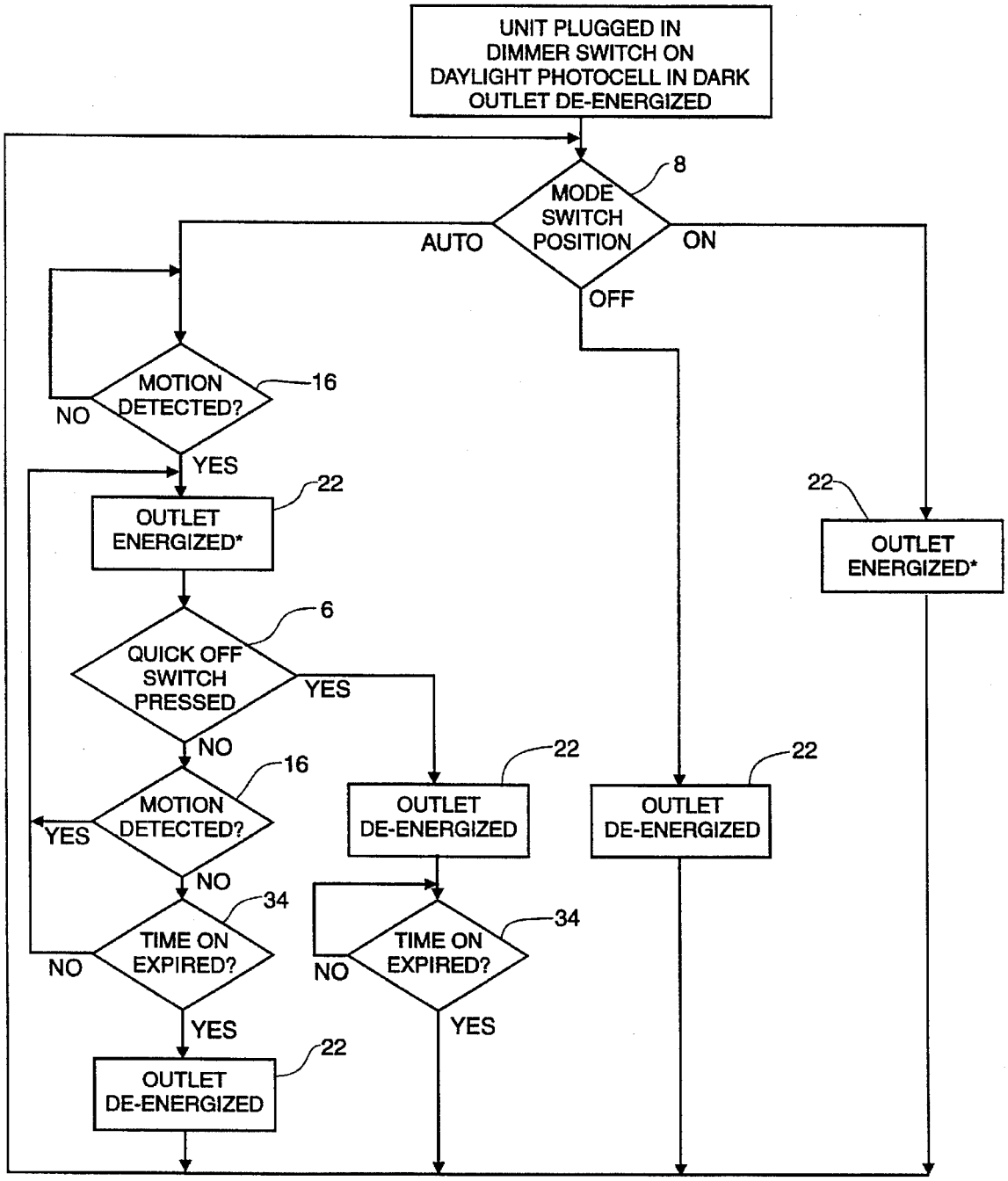
FIG. 3 is an operation flowchart for the motion detection light controller system according to the present invention.

As an example of the present invention in operation, a typical application would consist of providing an automatic means to turn on a lamp for a person who enters a darkened living space, and then automatically turn off the lamp after a set time. Such an application is depicted in the flowchart shown in FIG. 3. The mode selection means 8 has three operation modes: "auto"; "off"; and "on". In the "auto" operation mode, as soon as an individual walks into or produces motion within the detection area(s), the lamp plugged into the controller system 1 will light up. The lamp remains on as long as motion continues to be detected. After motion ceases in the detection area(s) for a predetermined time, the lamp goes off. The lamp can be relit by walking into the detection area(s) again or setting the mode selection means 8 to "on". In the "on" mode, the lamp plugged into the controller system I will remain on regardless of motion or daylight. The "off" mode turns the controller system 1 off so that motion in the detected area(s) does not turn on the lamp.

Additional features and functions are currently envisioned for the preferred embodiment of the present invention. The manual quick-off override 6 is used to turn off the lamp when leaving the room before the time-on period expires. Pressing the manual quick-off override 6 will turn off the lamp for the remainder of the time-on period. If no motion is still detected after the time-on period expires, the lamp will remain off. If motion is detected after the time-on period expires, the lamp will again turn on. After this feature has been activated, the lamp can be relit quickly again by momentarily setting the mode selection means 8 to the "off" position, then back to the "auto" position. The lamp will then remain on for the remainder of the original time-on period. The lamp can also be relit quickly by setting the mode selection means 8 to the "on" position to keep the lamp on regardless of time-on period, motion, or daylight. Also, although not considered a necessary part of the invention, it is currently envisioned that a sensitivity adjustment means 10 can be incorporated in order to allow the user to adjust the length and size of the detection range. A shorter detection area may be desired if the infrared pyroelectric sensors 16 are aimed toward a door leading to a hallway, so that a lamp does not turn on every time someone walks by the door. A larger detection range may be desired for larger rooms or different detection situations.

Figure 4A:
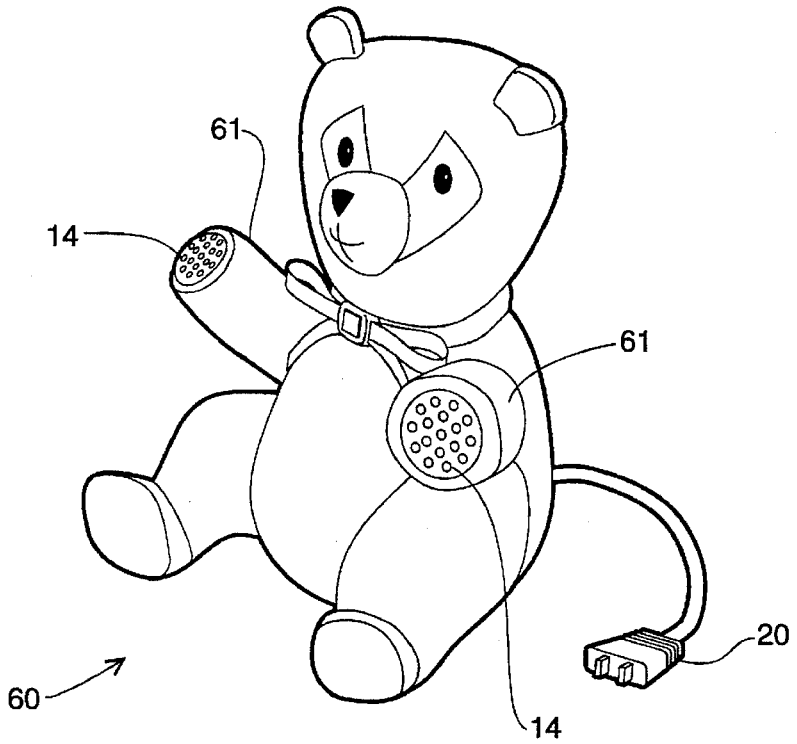
FIG. 4A is a front perspective view of one embodiment of a decorative article incorporating the present invention within, this particular embodiment being a child's teddy bear toy.
Figure 4B:
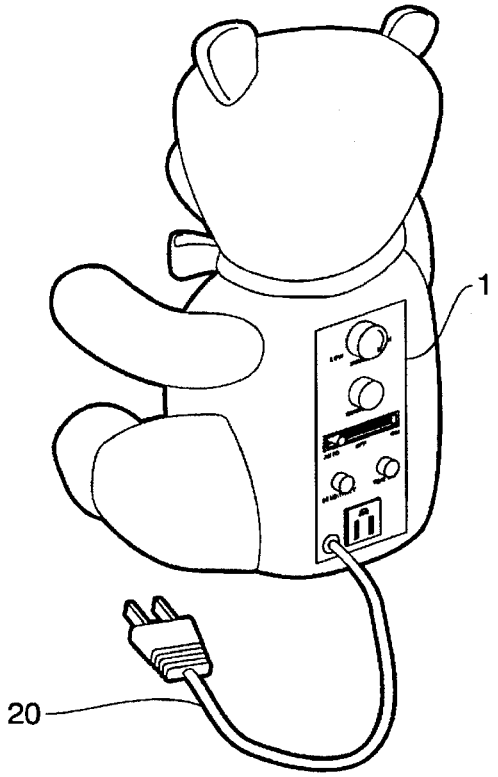
FIG. 4B is a rear perspective view thereof.
Figure 5A:
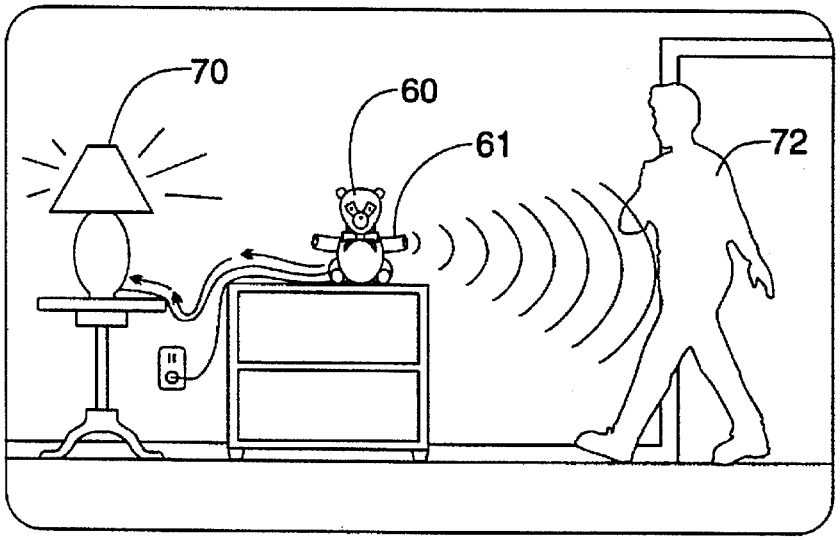
FIG. 5A is a graphical illustration of an application utilizing the embodiment thereof.
Figure 5B:
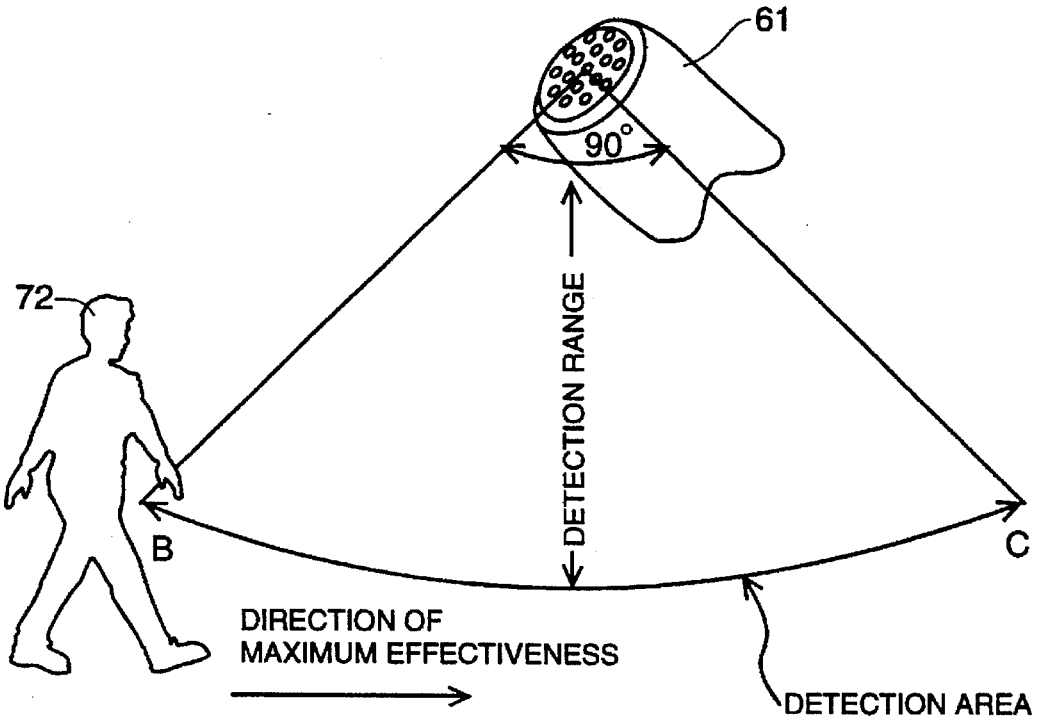
FIG. 5B is an exploded detail graphical illustration of a typical infrared sensor detection pattern.

In accordance with one embodiment of the present invention, as shown in FIG.4A and 4B, the motion detection light controller system 1 is shown housed within a decorative object, in this case a child's toy teddy bear 60. In this particular embodiment, the Fresnel lenses 14 are incorporated into the bear's paws 61. The use of this particular embodiment is further depicted in FIG. 5A and FIG. 5B, wherein the child's toy teddy bear 60 is placed within a living area and connected to a standard lamp 70. When an person 72 enters the detection area, indicated by the arc B-C, the detection will occur and the system 1 will operate as described above.

The foregoing description is included to illustrate the operation of the preferred embodiment and is not meant to limit the scope of the invention. As those skilled in the art could foresee, many alternate embodiments of the present invention could be configured. For example, many types of decorative enclosures are seen as possible. Another alternate embodiment that is currently envisioned could be to separate the power supply, light dimmer, power relay, and outlet into a separate unit and relocate them remotely from the main electronics. In such a configuration a power/relay assembly could be plugged directly into a wall outlet and be connected to the main electronics by a single multi conductor cable. The scope of this disclosure is to be broadly construed to include such variations which could be developed based upon the current disclosure. Therefore, the scope of the invention is to be limited only by the following claims.

What is claimed is:

1. A motion detection light controller system for automatically turning on and off a standard external appliance, wherein said controller system comprises:

a. at least one infrared pyroelectric sensor, said sensor capable of converting infrared energy into a first electronic signal;

b. a Fresnel lens mounted and affixed to said infrared pyroelectric sensor such as to gather infrared energy and focus said infrared energy onto said infrared pyroelectric sensor;

c. an adjustable time-on timer for adjustably setting a desired shutoff delay duration;

d. a power cord for providing a standard supply of 120 volt, alternating current electrical energy;

e. a power outlet for providing a connection source of electrical power for powering an external appliance;

f. a power relay for controlling the flow of electricity from said power cord to said power outlet;

g. a relay driver logic circuit for controlling said power relay;

h. a detector timer assembly for comparing said first electronic signal generated from said infrared pyroelectric sensor to a reference signal and for actuating said adjustable time-on timer when said first electronic signal exceeds said reference signal to thereby deliver an energizing signal to said power relay until the expiration of said shutoff delay duration;

i. a power supply for providing isolated, low voltage power to said infrared pyroelectric sensor, said detector timer assembly, said power relay and said relay driver logic circuit;

j. a manual quick-off override means for de-energizing said power relay and permitting said power relay to re-energize under control of said relay driver logic circuit; and k. a portable housing for storing and containing at least said time-on timer, said power outlet, said power relay, said relay driver logic circuit, said power supply, said detector timer assembly, and said quick-off override means.

2. A motion detection light controller system for automatically turning on and off a standard external appliance, the controller system comprising a child's toy, two motion sensors attached one each to distal ends of limbs of the child's toy, and a means for turning on a standard external appliance for a pre-determined time period when the motion sensors detect motion, the means housed within the child's toy.

3. The system of claim 2, wherein said child's toy resembles a teddy bear and said distal ends of limbs are front paws.

4. A motion detection light controller system for automatically turning on and off a standard external appliance, wherein said controller system comprises:

a. at least one infrared pyroelectric sensor, said sensor capable of converting infrared energy into a first electronic signal;

b. a Fresnel lens mounted and affixed to said infrared pyroelectric sensor such as to gather infrared energy and focus said infrared energy onto said infrared pyroelectric sensor;

c. an adjustable time-on timer for adjustably setting a desired shutoff delay duration;

a power cord for providing a standard supply of 120 volt, alternating current electrical energy;

e. a power outlet for providing a connection source of electrical power for powering an external appliance;

f. a power relay for controlling the flow of electricity from said power cord to said power outlet;

g. a relay driver logic circuit for controlling said power relay;

h. a detector timer assembly for comparing said first electronic signal generated from said infrared pyroelectric sensor to a reference signal and for actuating said adjustable time-on timer when said first electronic signal exceeds said reference signal to thereby deliver an energizing signal to said power relay until the expiration of said shutoff delay duration;

i. a power supply for providing isolated, low voltage power to said infrared pyroelectric sensor, said detector timer assembly, said power relay and said relay driver logic circuit;

j. a sensitivity adjustment means for manually adjusting the detection range of said infrared pyroelectric sensors;

k. a portable housing for storing and containing at least said time-on timer, said power outlet, said power relay, said relay driver logic circuit, said power supply, said detector timer assembly, and said sensitivity adjustment means; and.

1. said portable housing comprising a child's toy, two said Fresnel lenses mounted one each onto distal ends of limbs of said child's toy.

5. The system of claim 4, wherein said child's toy resembles a teddy bear and said distal ends of limbs are front paws.

* * * * *